United States Patent [19]

Hogan, Sr.

[11] Patent Number: 4,623,212

[45] Date of Patent: Nov. 18, 1986

[54] TWIST-TIGHTENED ELECTRICAL TERMINAL CONNECTOR

[76] Inventor: Wayne C. Hogan, Sr., P.O. Box 671, Ione, Wash. 99139

[21] Appl. No.: 581,682

[22] Filed: Feb. 21, 1984

[51] Int. Cl.[4] ..... H01R 11/26

[52] U.S. Cl. ..... 339/236; 339/238; 339/274

[58] Field of Search ..... 339/229, 230 R, 230 C, 339/238, 239, 236, 263 B, 266 R, 274, 244 B

[56] References Cited

U.S. PATENT DOCUMENTS

| | | | |
|---|---|---|---|
| 1,859,545 | 5/1932 | Wallenberg et al. | 339/229 |
| 1,953,821 | 4/1934 | Rabe | 339/238 |
| 1,993,391 | 3/1935 | Weaver | 339/244 B |
| 2,622,120 | 12/1952 | Knasko et al. | 339/236 |
| 3,457,542 | 7/1969 | Wolf | 339/236 |
| 4,576,430 | 3/1986 | Dufresne | 339/238 |

*Primary Examiner*—Gil Weidenfeld
*Assistant Examiner*—Paula Austin
*Attorney, Agent, or Firm*—Robert A. Hirschfeld; James F. Duffy

[57] ABSTRACT

An improved electrical terminal connector incorporates a sleeve encompassed by a single turn frustoconical circumferential thread, an anti-bind tab for resisting anti-disengagement binding forces, and a hand-graspable nut capable of being constructed of insulating and/or corrosion-resistive or lubrication impregnated material.

8 Claims, 5 Drawing Figures

TWIST-TIGHTENED ELECTRICAL TERMINAL CONNECTOR

BACKGROUND

1. Field of the Invention

This invention relates generally to electrical terminal connectors and more specifically to an electrical terminal connector which is readily tightened and quickly released by manual rotation of a cap nut.

2. Prior Art

In the past, twist-tightened electrical terminal connectors for connection to protruding battery terminal posts and the like, have employed a plurality of relatively fine threads, requiring several turns of a nut in order to achieve intimate electrical compression contact of the connector with the protruding terminal post. Because of the large surface contact area of said threads, these connectors were particularly vulnerable to galling and to the corrosive effects of battery acid and other environmental reagents, making disengagement difficult.

Prior art twist-tightened connectors employed one or more compressible or expansible slots, the gap of which was reduced upon the compressive application of a cap nut, and increased when compression was released by unscrewing the nut. Said slot or slots, essentially orthogonal to and cutting across said threads, tended to expand and bite into the nut threads upon attempted disengagement, thereby making more difficult or impossible manual removal of the connectors. Multiple thread coupling between cap nut and connector led to galling, which further hindered ready decoupling of nut and connector. Corrosive effects further inhibited ready removal of the cap nut.

Because of the use of a plurality of threads, said nuts were usually constructed of metal, and were thus conductive between the terminal post and the grasping hand or other object. Lubricants or anti-corrosive chemicals could be dispersed or washed off inadvertently from surfaces of such metal prior art nuts.

A need existed for a twist-tightened electrical terminal connector which required less thread coupling for tightening; which provided a coarse, corrosion-resistant thread engagement having relatively small contact area between connector and cap nut; in which the anti-disengagement binding of expansible slots against threads was minimized or eliminated, in which insulated material could be employed in the cap nut member grasped by hand or contacted by other objects; in which one connector member could be impregnated with anticorrosive chemical; and in which one connector member could be impregnated with a lubricant for reducing anti-disengagement friction.

An object of this invention is to provide an improved twist-tightened electrical terminal connector.

A further object of this invention is to permit manual tightening of an electrical terminal connector in less than one full rotation of a cap nut.

Another object of this invention is to reduce the contact area between threads in a twist-tightened electrical terminal connector and threads in a cap nut, so as to reduce difficulty of removing when corroded, and to reduce any tendency of galling.

It is also an object of this invention to provide finger-operated anti-binding means for resisting the tendency of a compressible slot to bind said threads upon attempted disengagement.

Yet another object of this invention is to insulate the electrical connector from a grasping hand or other object.

Still another object of this invention is to impregnate a porous member of the electrical connector with a lubricant, to reduce mechanical force in disengagement.

It is a further object of this invention to impregnate a porous member of the electrical connector with an anti-corrosive chemical.

SUMMARY OF THE INVENTION

In accordance with one embodiment of this invention, a twist-tightened electrical terminal connector comprises a sleeve internally shaped so as to snugly fit a protruding electrical terminal, which may be cylindrical, frustoconical (as in automotive storage batteries), frustopyramidal, or the like. The exterior of the connector is threaded with a single-turn frustoconical thread. An expansible slot communicates between the internal surface of the sleeve and the exterior, threaded surface, in a plane generally parallel to the direction of engagement of connector and terminal, and approximately orthogonally intersecting said single thread turn. A finger-operated anti-bind tab is disposed to resist the tendency of the slot to spread during connector disengagement. Electrical connection to a cable or wire is provided by swaging, soldering or clamp means.

The single-turn thread is engaged by a mating thread on the interior of a hand-graspable cap nut. Rotating said nut in one direction compresses the sleeve into intimate electrical contact with the terminal, while counter-rotation releases compression, permits the slot to open, and the interior surface of the sleeve to move away from the surface of the terminal, whereby the sleeve is readily disconnected from the terminal.

The nut has an exterior surface easily grasped by hand, such as a castellated surface, and is either metal or electrically non-conductive for insulation of grasping hands or of other objects.

To reduce corrosion, a nut constructed of porous material is disclosed, which is impregnated with an anti-corrosive chemical.

To reduce anti-disengagement friction, a nut constructed of porous material is disclosed, which is impregnated with a lubricant.

Because a single coarse thread is disclosed, nut fabrication from insulating or porous material is less likely to suffer from mechanical stress and breakage than if a plurality of more fragile, finer threads were employed.

Compression of the sleeve is accomplished by virtue of the inward force resulting from screwing of the frustoconical nut thread down into the corresponding frustoconical thread on the exterior of the sleeve.

When removing the connector from the terminal, one hand grasps and rotates the nut, while a finger of the other hand presses the anti-bind tab, so as to prevent the sleeve slot from widening and binding the sleeve against the thread of the nut. When such binding occurs, without the anti-bind tab, further rotative force upon the nut would tend to drive an interfering edge of the slot deeper into the thread, increasing the binding force. The anti-bind tab reduces or eliminates the disengagement binding problem.

DETAILS OF THE INVENTION

Figure 1:
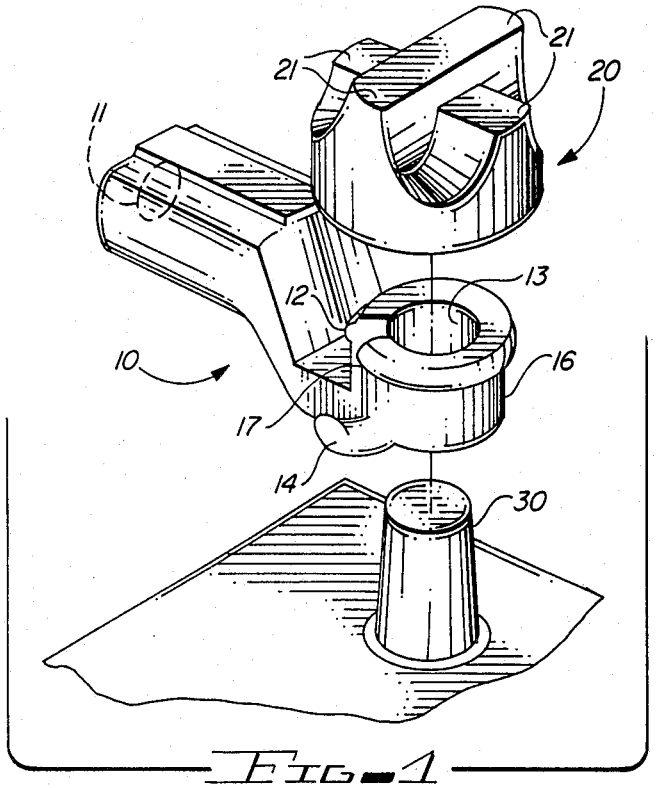
FIG. 1 is an exploded perspective assembly of the twist-tightened electrical terminal connector, with nut and typical frustoconical auto storage battery terminal.

For the purpose of promoting an understanding of the principles of the invention, reference will now be made to the embodiments illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, an exploded perspective assembly view shows a twist-tightened electrical terminal connector generally referred to as reference numeral 10, to which a wire or electrical cable is attached at 11 by swaging, soldering, clamping or like means. The interior surface 13 of sleeve 16 is shown as the frustoconical mate to the typical auto storage battery terminal 30. Connector 10 is lowered onto terminal 30 until a snug fit occurs, in which condition, slot 15 is open as shown in FIG. 1 and FIG. 3A.

Figure 2:
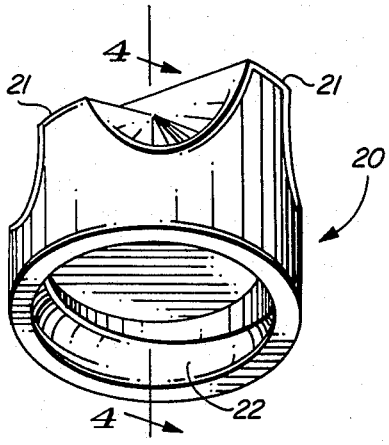
FIG. 2 is a perspective view of the castellated nut.
Figure 4:
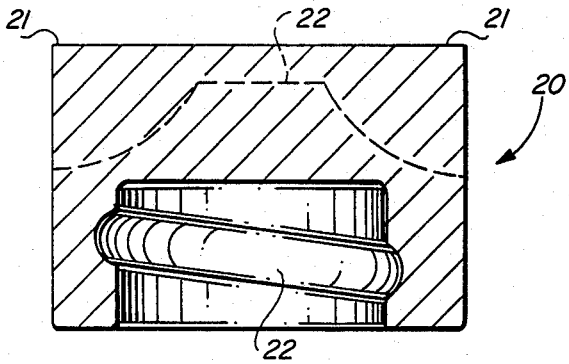
FIG. 4 is a cross-sectional view of the nut.

Castellated nut 20, FIGS. 1, 2, 4, having castellations 21 for ease in hand-grasping, is screwed onto single-turn thread 12. As tightening is increased, sleeve 16 is compressed, slot 15 is reduced in width, and intimate electrical contact between surface 13 and terminal 30 is achieved.

In FIG. 1, thread 12 is shown for convenience as tightening with clockwise rotation of nut 20. Counterclockwise rotation of nut 20, in untightening, tends to force edge 17 of slot 15 into the interior surface of nut 20 and thus inhibit the removal of nut 20. Such anti-disengagement binding is prevented by pressing anti-bind tab 14 in direction 40 (FIG. 3A) while unscrewing nut 20.

Figure 3A:
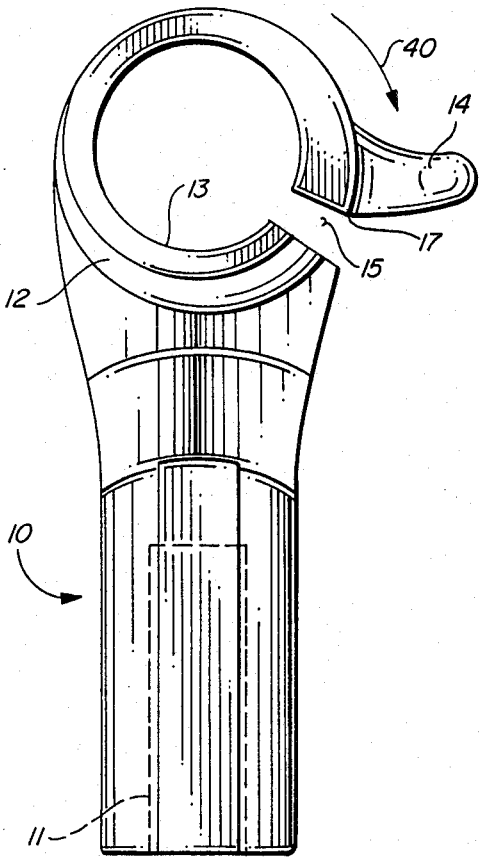
FIG. 3A is a top view of the twist-tightened electrical terminal connector.
Figure 3B:
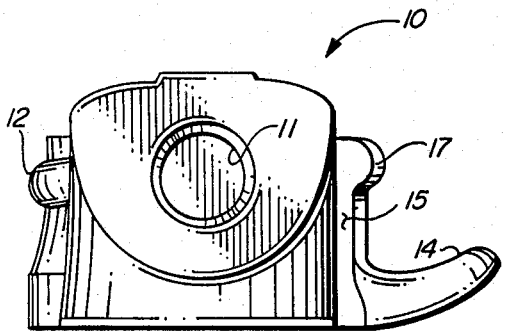
FIG. 3B is an end view of the twist-tightened electrical terminal connector.

Top view, FIG. 3A and end view, FIG. 3B, more clearly show the disposition of thread 12, slot 15, slot edge 17, and anti-bind tab 14. FIG. 3B also illustrates one embodiment for swaging or soldering wire or cable to connector 10,, by insertion in hole 11.

A cross-sectional view of nut 20, in FIG. 4, illustrates the single, coarse thread 22, mechanical integrity of which, compared to a plurality of fine threads, is suitable for fabrication of nut 20 from insulating or porous material. Where sleeve 16 and nut 20 are both made of metal, e.g. lead, nut 20 may be made harder than sleeve 16, e.g. by the addition of extra antimony, to reduce any tendency of the nut thread 22 and the sleeve thread 12 to gall and bind together. If nut 20 is made from a porous material, it may be impregnated with a lubricant and/or an anti-corrosion chemical.

While those skilled in the art will conceive of other embodiments of the invention drawn from the teaching herein, it is intended that such other embodiments, so drawn, shall fall within the ambit of protection of the claims appended hereto.

Having described my invention in the foregoing specification and drawings in such full detail that those skilled in the art may readily understand and practice the invention, that which I claim is:

1. A twist-tightened electrical terminal connector comprising:

a sleeve having an interior surface for releaseably engaging and electrically contacting an electrical terminal, said sleeve having an exterior frustoconical circumferential thread, and a single expansible slot communicating between said interior surface and said exterior circumferential thread; and an anti-bind tab means coupled to said sleeve for resisting disengagement expansion of said slot and said circumferential thread.

2. The twist-tightened electrical terminal connector of claim 1 further comprising;

a hand-graspable nut having an interior frustoconical circumferential thread, rotatably coupleable to said exterior frustoconical circumferential thread of said sleeve, for releaseably exerting compressive force upon said sleeve.

3. The twist-tightened electrical terminal connector of claim 2, wherein said interior surface of said sleeve is frustoconical to matingly couple with a protruding frustoconical terminal of an automotive storage battery.

4. The twist-tightened electrical terminal connector of claim 3, wherein said anti-bind tab means comprises a finger-engageable member coupled to the exterior of said sleeve, and disposed so as to exert, under manual pressure, a compressive force upon said sleeve.

5. The twist-tightened electrical terminal connector of claim 4, wherein said hand-graspable nut is castellated for ease of grasping.

6. The twist-tightened electrical terminal connector of claim 5, wherein said hand-graspable nut is electrically non-conductive, for electrical insulation of said electrical terminal connector from grasping hands or other objects.

7. The twist-tightened electrical terminal connector of claim 6, wherein said hand-graspable nut is comprised of porous material, impregnated with a lubricant for reducing anti-disengagement friction.

8. The twist-tightened electrical terminal connector of claim 7, wherein said hand-graspable nut is comprised of porous material, impregnated with an anti-corrosive chemical.

* * * * *